US007817906B2

(12) United States Patent
Callahan et al.

(10) Patent No.: US 7,817,906 B2
(45) Date of Patent: Oct. 19, 2010

(54) DIRECT ELECTRIC RESISTANCE LIQUID HEATER

(75) Inventors: Jeremiah M. Callahan, Sullivan's Island, SC (US); James E. Barzyk, Naperville, IL (US); John H. Bowers, Clarksburg, NJ (US)

(73) Assignee: ISI Technology, LLC, Sullivan's Island, SC (US)

( * ) Notice: Subject to any disclaimer, the term of this patent is extended or adjusted under 35 U.S.C. 154(b) by 1075 days.

(21) Appl. No.: 11/352,184

(22) Filed: Feb. 10, 2006

(65) Prior Publication Data

US 2006/0291527 A1 Dec. 28, 2006

Related U.S. Application Data

(60) Provisional application No. 60/677,552, filed on May 4, 2005, provisional application No. 60/709,528, filed on Aug. 19, 2005, provisional application No. 60/726,473, filed on Oct. 13, 2005.

(51) Int. Cl.
*H05B 3/60* (2006.01)

(52) U.S. Cl. ..... 392/331; 392/311; 392/324

(58) Field of Classification Search ..... 392/311, 392/314, 331

See application file for complete search history.

(56) References Cited

U.S. PATENT DOCUMENTS

| | | | |
|---|---|---|---|
| 4,900,896 | A | 2/1990 | Maus |
| 5,091,612 | A | 2/1992 | Van Fossen |
| 5,216,743 | A | 6/1993 | Seitz |
| 5,325,822 | A | 7/1994 | Fernandez |
| 5,408,578 | A | 4/1995 | Bolivar |
| 5,479,558 | A | 12/1995 | White, Jr. et al. |
| 5,866,880 | A | 2/1999 | Seitz et al. |
| 6,080,971 | A | 6/2000 | Seitz et al. |
| 6,080,973 | A | 6/2000 | Thweatt, Jr. |
| 6,130,990 | A | 10/2000 | Herrick et al. |
| 6,246,831 | B1 | 6/2001 | Seitz et al. |
| 6,389,226 | B1 | 5/2002 | Neale et al. |
| 6,522,834 | B1 | 2/2003 | Herrick et al. |
| 6,552,283 | B2 | 4/2003 | Cabrera et al. |
| 6,640,048 | B2 | 10/2003 | Novotny et al. |
| 6,701,069 | B1 | 3/2004 | Cezayirli et al. |
| 6,834,160 | B1 | 12/2004 | Chen-Lung et al. |
| 6,849,178 | B2 | 2/2005 | Hecking |

*Primary Examiner*—Thor S Campbell
(74) *Attorney, Agent, or Firm*—Lerner, David, Littenberg, Krumholz & Mentlik, LLP

(57) ABSTRACT

The Direct Electric Resistance Liquid Heater comprises a liquid heating chamber containing a plurality of electrodes. The electrodes are spaced apart to create a plurality of channels through which the liquid to be heated passes. The electrodes are each connected to a power supply by one or more switches. A controller controls the switches based upon data received from a temperature sensor, sensing the temperature of the liquid, and/or an electric current sensor, sensing the current utilized by the liquid heater. Selection of the number and spacing of the electrodes, and the number of switches, provides the controller with various current levels options to apply to the liquid to be heated. The current levels available due to the number and spacing of the electrodes and the number of switches, span the range from minimum current to maximum current such that the controller can incrementally increase or decrease the current applied to the liquid to be heated without disrupting other users of the same power source.

28 Claims, 5 Drawing Sheets

DIRECT ELECTRIC RESISTANCE LIQUID HEATER

This application claims the benefit of U.S. Provisional Application(s) Nos.

60/677,552 May 4, 2005
60/709,528 Aug. 19, 2005
60/726,473 Oct. 13, 2005

FIELD OF INVENTION

This invention is directed towards an electrically powered tankless electrically conductive liquid heater that provides instant, on demand heating of the liquid.

BACKGROUND OF THE INVENTION AND PRIOR ART

The objectives of an electrically powered tankless liquid heating device include, at a minimum, provision of the heated liquid on demand, regulation of the temperature of the heated liquid so as not to exceed a maximum temperature set point, operation below a maximum electrical current set-point, safety of operation, minimal disturbance to the power supply and low cost to manufacture. Prior art liquid heating devices have attempted to achieve these objectives, but have been only partially able to do so.

Most prior art electrically powered tankless liquid heating devices use resistance type electrical heating elements to heat the liquid. Although the use of electrical heating elements is well known and widely practiced, in tankless liquid heating devices, they suffer from considerable disadvantages. One of the most important of these is the occurrence of "dry firing", i.e., operation of the heating element when it is not completely immersed in the liquid, or when excessive deposits are formed along the surface of the heating element, thus enabling operation of the heating element outside of its safe temperature range and introducing the possibility of shortened life span, element failure, system meltdown, or even fire. Additional functional and costly components are required to address this. Maus, in U.S. Pat. No. 4,900,896, provides an example of such a heater. A flow detection switch (which must carry the entire electrical current consumed by the heating elements) detects the condition of no water flow, thus preventing dry firing of the heating elements where there is insufficient water in the heating chamber. However, when the heating element is covered with deposits that are relatively thermally non-conducting, the thermostat is not thermally connected to the heating element and thus the thermostat does nothing to prevent overheating of the electric heating element. Other tankless water heaters using electric heating elements that suffer the same disadvantage and the mechanisms to address it are described in U.S. Pat. Nos. 5,216,743 issued to Seitz, 5,325,822 issued to Fernandez, 5,408,578 issued to Bolivar, 5,479,558 White, Jr. et al, 5,866,880 issued to Seitz et al, 6,080,971 issued to Seitz et al, U.S. Pat. Nos. 6,246,831 issued to Seitz et al, and 6,834,160 issued to Chen-Lung et al. The primary mechanism in '743 is an automatic vapor release outlet to ensure that the temperature sensors sense liquid temperature. This mechanism clearly does not function after the heater has been drained for servicing or for periods of no use. In '822, liquid level sensors are used. However, these are only effective in one mounting orientation of the heater. '578 provides two ports between two heating chambers to ensure that water enters the two chambers more or less equally, thereby preventing that one of the heating elements in one of the chambers can overheat while the other is filling with water. A flow-sensing switch is also used to prevent application of power unless water flow is detected. However, a flow-sensing switch is generally expensive and not reliable. '558 uses the combination of a sophisticated flow detector and thermal sensors, one for regulating temperature, the other for sensing an over temperature condition. The flow detector uses a plunger that is constrained to move vertically, thus constraining the heater to installation in only one orientation. Besides, as described, it is subject to binding and getting stuck in one position, including possibly a position that indicates the existence of water flow when there is none. This solution is expensive, unreliable, and suffers the same problems as '896. '880 provides high temperature limit switches. These are inoperative when there is not a high thermal conductivity thermal path between heaters and the switches, such as when the heater is without water. The '971 and '831 patents provide over temperature switches thereby suffering the previously mentioned disadvantages.

Another disadvantage of liquid heaters that utilize resistance type electric heating elements is that the elements themselves have substantial thermal mass and thermal resistance. This creates the problem of how to manage the latent heat (the heat which has not yet escaped) of the elements when the liquid flow rate is abruptly reduced to near zero or zero. This latent heat must be absorbed by the liquid surrounding the elements. However, doing so increases the temperature of the surrounding liquid, possibly to an undesirable extent. Thus, the volume of the heating chambers must be made larger to avoid overheating of the liquid, for example, to prevent scalding if the liquid heater is a domestic hot water heater. This is also necessary to stabilize the operation of any temperature control loop or else high variations in temperature of the heated liquid will occur. However, these larger heating chambers make it difficult to respond to demand changes, especially when the water flow rate starts from zero.

As previously mentioned, deposits tend to form on the heating elements. Seitz discloses that the amount of mineral deposition is a function of the maximum heating element temperature in '880, and thus the desirablity of providing power to the heating elements as a function of the power needed to heat the water passing through the disclosed heater to minimize such depositions. In the '558 patent, White, Jr. also identifies a different reason for doing this—to minimize power supply voltage fluctuations due to heater power demands that can cause flickering of lights. Unfortunately, the best semiconductor devices for controlling current to electrically powered water heaters are essentially switches (they can be opened and closed, but they don't provide a means for regulating current), thus making this a significant problem. White Jr. addresses this by incorporating multiple equally sized heating elements. However, this only reduces the magnitude of the potential power supply voltage variations by a factor of the number of heating elements, in the case of his example, four. The '880 patent echoes this approach. Seitz, in the '971 and '831 patents, discloses various methods for minimizing the power supply variations caused by variations in the heater power demand and the visible flickering of lights and electrical interference that results there from. These methods generally relate to the use of multiple heat elements and the timing of the application of power to them so as to minimize power supply current fluctuations, or to make these power supply fluctuations such that they are not readily perceived. These lead to a relatively high level of design complexity and a correspondingly high manufacturing cost.

The predominant alternative to using heating elements to heat the liquid is to pass an electrical current through the liquid by passing it between two electrodes between which a voltage exists. The voltage is preferably an AC voltage so as to avoid electrolysis of the liquid. This method is known as direct electrical resistance (DER) heating. Probably the most common application of this approach (although relatively crude) is in vaporizers used to humidify room environments. One reason for the popularity of the approach is that it is intrinsically safe: no electrical current can flow if there is no liquid between the electrodes.

One example of a DER liquid heater is disclosed in U.S. Pat. No. 6,130,990 issued to Herrick et al for use in a beverage dispenser. The advantages of "rapid and efficient transfer of electrical energy into the water as thermal energy while reducing the energy loss associated with indirect heating methods" are disclosed. One of the disadvantages of the DER method, however, is that the amount of electrical current drawn by the liquid between the electrodes, and therefore the amount of heat delivered to the liquid, is determined by the electrical conductivity of the liquid, a parameter that can vary quite widely, for example 10 to 1. One method of controlling the temperature contemplated in this patent is by varying the water flow rate. Another is by varying the electrical power delivered to the water, which would require varying the power supply voltage. A third involves mechanically adjusting the distance between the electrodes. It is evident that accommodating such wide range of liquid conductivities by any of these methods is quite difficult. In fact, the inventors contemplate the possibility of treating the water with minerals prior to passing it through the heater in order to increase the water conductivity. In U.S. Pat. No. 6,522,834 also issued to Herrick et al, which is a continuation in part of the '990 patent, a new element, a power supplier, is introduced specifically to overcome this issue. Essentially, it is a power converter that receives power from a convention power supply (for example, 220VAC @ 60 Hz), and converts it such that the output voltage is adjustable and which may have a frequency range from 50 Hz to 200 KHz. This was apparently driven by the need to accommodate the large range of water conductivities and the inadequacy of the other previously mentioned methods. U.S. Pat. No. 6,640,048 issued Novotny et al discloses a DER liquid heater that provides another adjustment mechanism that addresses the wide range of liquid conductivities. It mechanically varies the area of the electrodes (and the effective distance between them) by adjustably interposing an electrically non-conducting current gating plate between the electrodes, thus adjusting the electrical conductance of the heating zone comprising the electrodes and the liquid between them. However, no disclosure of the range of adjustability of the device is disclosed. Furthermore, the mechanical adjustment involves the translation of motion across a liquid to air barrier, something that is difficult to achieve reliably and at low cost.

DER liquid heaters must also address other difficulties that are in common with heaters utilizing resistance type electrical heating elements. An example of these is the use of a flow switch to control the application of power to the heater. Flow switches are generally characterized by a flow rate threshold, below which they do not indicate a flow, although a low flow may be present. This allows for unheated liquid to leave the heater at low flow rates (unlike conventional tank type heaters), and it tends to generate a delay between the time liquid flow is demanded and the time fully heated liquid is finally delivered thus creating a wastage of liquid. This, together with the presence of orientation limitations, unreliable functioning and cost must be overcome in a tankless liquid heating device that meets the objectives cited above. Additionally, the previously mentioned difficulties associated with latent heat management, the design and operation of temperature control loops, formation of deposits, and minimization of power supply variations and the corresponding light flicker must be overcome.

BRIEF DESCRIPTION OF THE INVENTION

In the present invention these and other difficulties, as will become apparent, are overcome in a direct electrical resistance liquid heater having many unique and previously undisclosed aspects. In one aspect, the invention comprises a liquid heating chamber with a liquid inlet and a liquid outlet in which a plurality of thin, spaced apart electrodes comprise an electrode array, the electrodes defining a plurality of channels, the spaces between the electrodes, through each of which liquid flows from the inlet to the outlet, and in which the liquid is heated when a voltage is connected between one or more pairs of electrodes. The use of thin electrodes avoids the creation of significant amounts of latent heat thus helping to minimize the potential response time to liquid flow rate or conductivity changes.

In a second aspect, the invention provides electrically operable switches connected between the electrodes and an AC power supply, the switches operated by a controller that selectively opens or closes the switches according the heating demand. The switches are closed for periods comprising one or more full AC cycles In a third aspect of the invention, the switches can connect the power supply to one or more pairs of electrodes with one or more unconnected electrodes between a connected pair, or alternatively, according to signals provided by the controller to the switches and the configuration of connections determined by it to provide the necessary power, can connect the power supply to adjacent electrodes alternately (adjacent electrodes are connected to opposite sides of the power supply and all electrodes are connected) such that the maximum current flows through every channel defined by the electrodes.

In a fourth aspect of the invention, the spacing between the electrodes is non-uniform, i.e., each and every channel width is different from the other channel widths.

In a fifth aspect of the invention, choice of electrode spacings or channel widths is such that a maximum number of more or less logarithmically spaced electrical current or power levels can be achieved with the appropriate selection switch connection configurations.

In a sixth aspect of the invention, an adequate number of current levels are defined, over a full range of liquid conductivities, to enable good operation of a temperature control loop and to provide current control such that a preset maximum current is not exceeded but is closely approached.

In a seventh aspect of the invention, the electrode spacings are chosen so as to cause a maximum semiconductor switch current that is minimized or selected so as to be able to utilize low cost semiconductor switches.

In an eighth aspect, the invention provides a thermal sensing element comprising a highly thermally conductive temperature sensing plate disposed at the hot end of the heating chamber within a short distance of the electrodes such that it is orthogonal to the liquid flow and such that the liquid passes through perforations in the temperature sensing plate, the temperature sensing plate thereby providing a good indication of the liquid temperature at the hot end of the heating chamber.

In a ninth aspect, a temperature sensor is thermally coupled to the sensing plate, the temperature sensor being a semiconductor junction such as that in a diode or bipolar transistor. The performance of these is highly repeatable.

In a tenth aspect of the invention, the controller senses and acts upon at least the temperature as measured by the temperature sensor and its rate of change.

In an eleventh aspect of the invention, the controller adjusts a maximum of one current level step every AC cycle. This together with the relatively small size of the current level steps provided by the invention avoids rapid changes in the current drawn from the power supply and eliminates light flicker.

In a twelfth aspect of the invention, the electrically operable switches are semiconductor switches the packages of which are both electrically and thermally coupled to the electrodes such that transfer of electrical energy and thermal energy occurs from the semiconductor switch to the electrode. The electrode is used to cool the semiconductor switch.

In a thirteenth aspect of the invention, the electrodes comprise the combination of oriented graphite and a small percentage of polymer and/or elastomer that acts to bind the graphite into a solid piece. This makes the electrodes mechanically robust and virtually eliminates problems with corrosion. These electrodes are also highly electrically and thermally conductive within the plane of the electrodes.

In a fourteenth aspect of the invention, the average rate of liquid flow is chosen to be such that it is approximately at the point at which turbulence begins. This tends to resist the formation of deposits on the electrodes. The selection of channel dimensions is a function of both the turbulence properties of the liquid flow and the electrical properties of the heating chamber, as described above. This results in a unique range of channel dimensions that simultaneously satisfy all of the requirements once the relative proportions of the channel widths have been established.

In a fifteenth aspect, the invention provides electrical current leakage current electrodes, one between the inlet and the heating chamber and the other between the temperature sensor and the outlet. These electrodes are connected to each other and to an electrically neutral voltage source.

In a sixteenth aspect, the invention provides a direct electric resistance liquid heater that does not incorporate a flow switch and is orientation independent. Control of heating power is determined strictly by the liquid temperature at the end of the heating chamber and a maximum current setpoint.

Details of the invention are provided below with reference to the accompanying Figures.

DETAILED DESCRIPTION OF THE INVENTION

Figure 1:
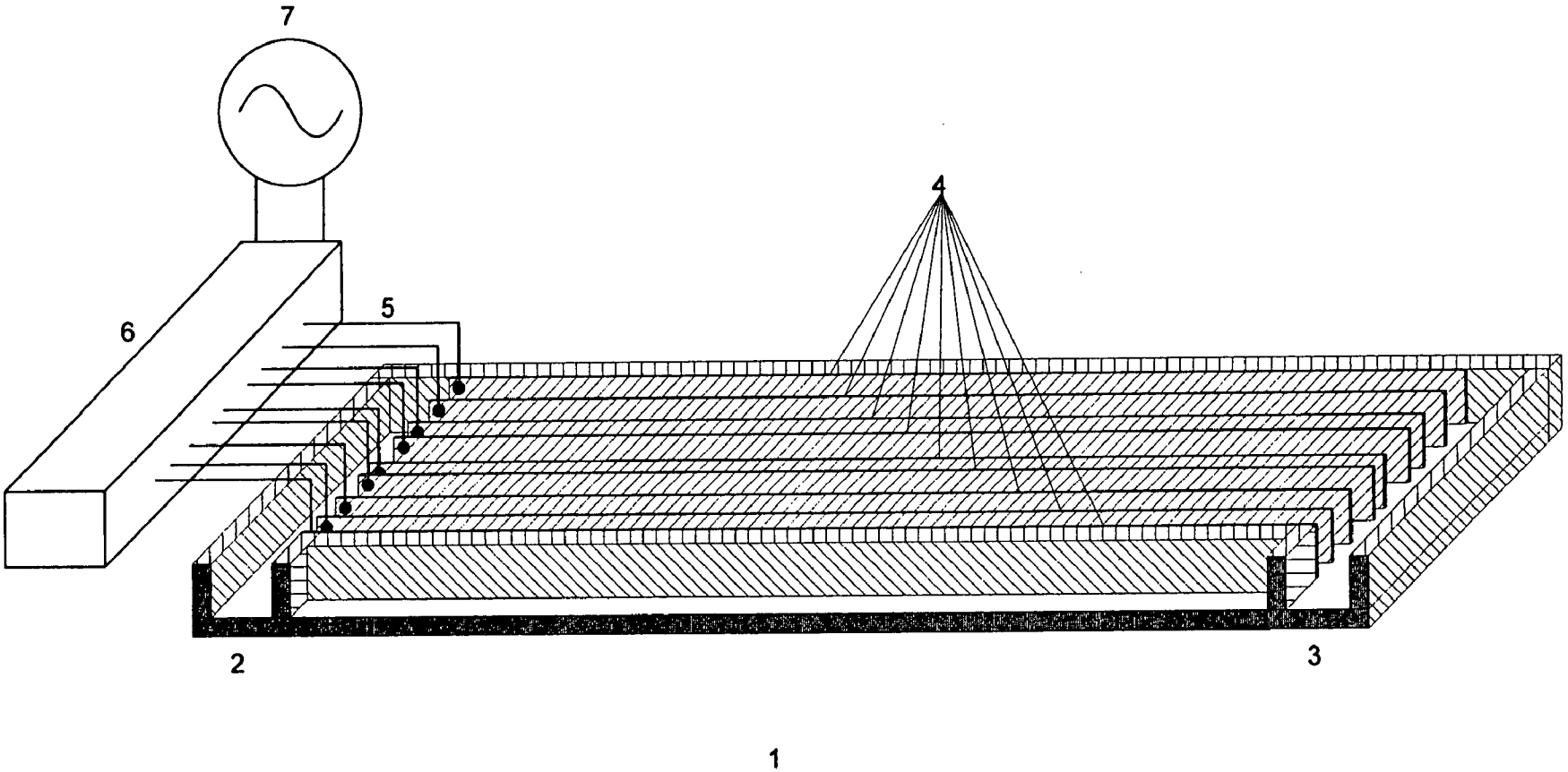
FIG. 1 is a schematic drawing of the DER liquid heating chamber, including the inlet, outlet, electrode array and the channels through which the liquid passes. The power source and switch matrix are also shown.

FIG. 1 shows essential elements of the present invention. A liquid heating chamber 1 is shown comprising a liquid inlet 2, a plurality of electrodes 4 (the electrode array), the electrodes defining a plurality of channels, the spaces between the electrodes, through each of which liquid flows from the liquid inlet 2 to the liquid outlet 3, the liquid being heated when it flows through the channels and a voltage is applied between electrodes. For clarity, the liquid heating chamber is shown with a bottom but without a top so that the electrodes and the channels defined by them can more clearly be seen. The electrodes 4 are shown in FIG. 1 as having a non-uniform or unequal spacing, which will be explained later. The electrodes 4 are connected via connections 5 to switch matrix 6 via which AC electrical power 7 is communicated to the electrodes. The electrodes 4 are thin relative to the width of the channels. The electrodes 4 are preferably thinner than the width of the narrowest channel. This minimizes the amount of latent heat that can be stored in the electrodes and provides some balancing of the heating in the heating chamber in that heat created in one channel can be communicated through the electrodes to adjacent channels.

FIG. 1 also shows some aspects that are exemplary and not to be construed as limiting. For example, the electrodes are shown as planar and parallel. This is not a limit to the scope of the invention. For example, the electrodes may be sections of cones of different radii coaxially located such that the required plurality of channels is formed (in this case the channels will also be conical) and be within the scope of the present invention. Any geometric configuration of electrically unconnected electrodes that defines a plurality of channels through each of which a liquid may be passed from the liquid inlet 2 to the liquid outlet 3 and which provides an electrically conductive path between the two endmost electrodes when an electrically conductive liquid is in the channels and the interposed electrodes are electrically unconnected is within the scope of the present invention.

Figure 2:
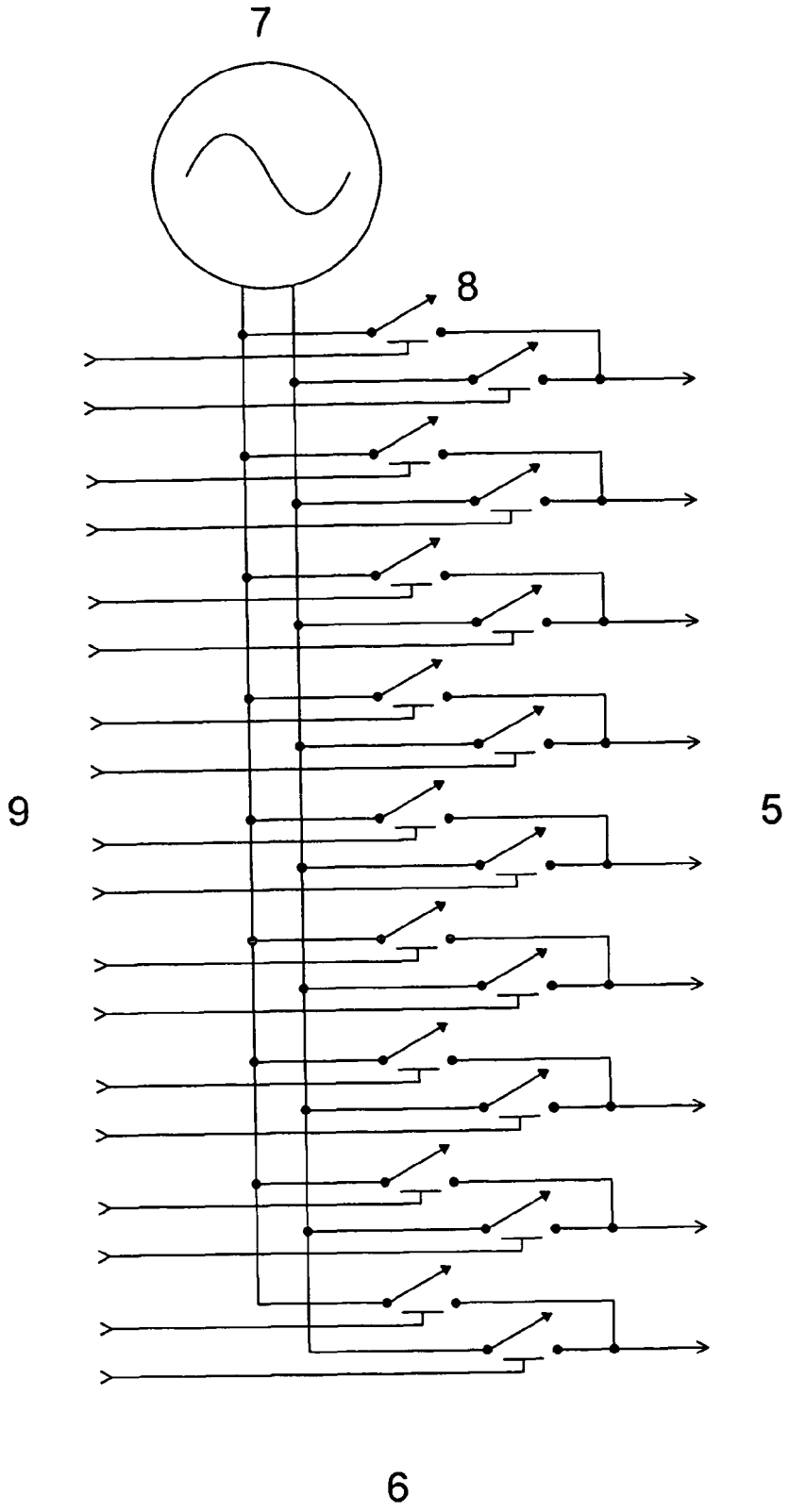
FIG. 2 is a more detailed schematic of switch matrix.

FIG. 2 shows the details of the switch matrix 6 and its connections to power supply 7. Shown are two switches 8 for each connection 5 to the electrodes, one of the two switches connected to one side or phase of the AC power supply 7 and the other of the two switches connected to the second side or phase of the AC power supply 7. However, a multiple phase power supply be used with as many switches per connection 5 as exist phases of the power supply. For example, with a three-phase power supply, there may be up to three switches per connection 5. All of the switches 8 are individually operable by their respective control signals 9. The switches 8 are any kind of electrically operable switch, i.e., a switch that utilizes an electrical input signal to operate the switch. Examples of suitable switches include relays and, more preferably, semiconductor switches such as triacs.

In operation, the switches are selectively closed by a controller, thereby placing the power supply voltage between electrodes. The power delivered to heat the liquid between the electrodes, generally proportional to the current drawn from the power supply, is a function of 1) the spacing between the electrodes and 2) the number of electrode pairs to which power is applied through switches 7. The switch matrix 6 of the present invention provides great flexibility in this regard. For example, when the minimum current is required, one of the switches 8 electrically connected to a first endmost electrode 4 (one of the two that define only one channel) is closed, thereby connecting the electrode to a first side of the power supply and one of the switches 8 electrically connected to the opposite endmost electrode (the electrode most distant from the first endmost electrode) is closed such that it is connected to a second side of the power supply. All of the other switches 8 remain open and therefore the electrodes 4 interposed between the endmost electrodes remain electrically unconnected. This places the maximum distance between the electrodes to which the voltage source can be connected, thereby causing the electrical conductance between the cells to be minimized and likewise the electrical current and therefore the power delivered to the liquid for heating to be likewise minimized. It is possible to increase the electrical current by connecting the power supply to an electrode via one of the switches 8 that is physically and closer to the first electrode. Thus, the present invention provides for adjusting the current, and power delivered for heating, according to the separation between the electrodes to which voltage is applied.

Applying the voltage of power supply 7 via switches 8 between two adjacent electrodes maximizes the amount of electrical current that is passed through the channel defined by them. It is also possible to adjust the liquid heating power by applying the voltage of power supply 7 power to one or more pairs of adjacent electrodes. Thus, in addition to the liquid heating power adjustment based upon distance between the electrodes to which voltage is applied, the present invention provides for adjustment of the total liquid heating power by controlling the number of pairs of electrodes that are simultaneously connected to the power supply through switch matrix 6. The concurrent use of both methods for controlling the heating power provides a much larger range of control of liquid heating power than can be achieved by either method by itself and therefore provides a way in which overcome the difficulty of a large range of liquid electrical conductivities and liquid flow rates.

It will be apparent to those skilled in the art that there are a large number of possible combinations of switch positions or switch configurations, i.e., 2 raised to the power of the number of switches. It is also apparent that some of these switch configurations are not useful. For example, it not useful to close a switch connected to an electrode that causes it to be connected to the same side of the power supply that electrodes on both sides of it are connected to, as this performs no useful function because there is no electrical field generated between the electrodes and therefore no current will flow through the switch connected electrode. Additionally, it is not useful to simultaneously close two switches connected to the same electrode as this will simply short the power supply. Switches are also relatively expensive components, so it is desirable to minimize their number. In a preferred embodiment of the invention, therefore, it is desirable to minimize the number of switches and switch combinations used. Most preferably, there is one switch per electrode, the switches connecting the electrodes to different terminals of the power supply in a round robin pattern, or if there are only two power supply terminals, in an alternating pattern. Comprising switch matrix 6 with one switch per electrode can normally provide an adequate number of switch configurations and corresponding current levels. However, there may be situations where the increase in the number of switch configurations is sufficiently worthwhile to justify more fully or fully populating the switch matrix 6 with more or all of the possible number of switches for making electrical connection between the electrodes and the power supply.

Figure 3:
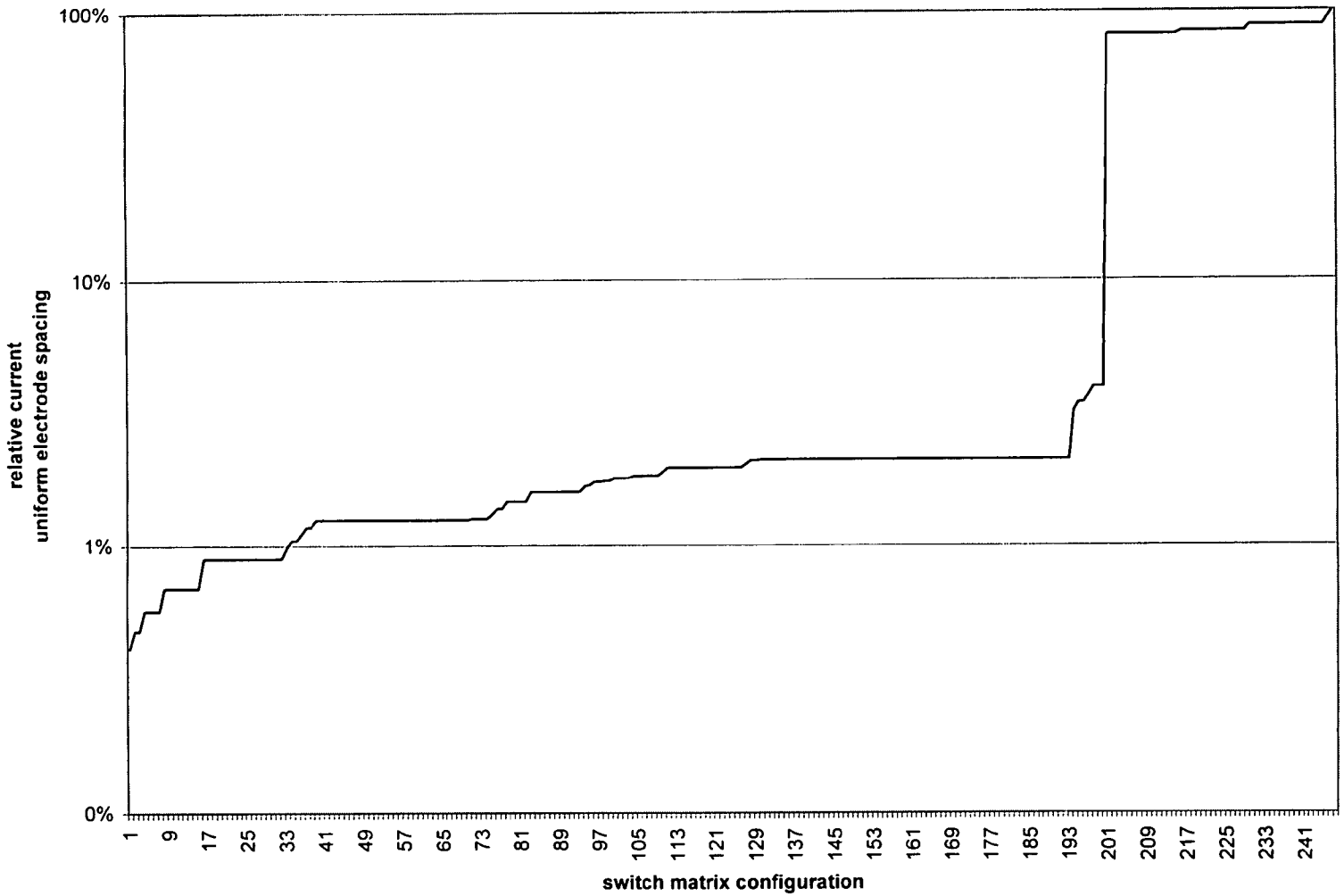
FIG. 3 is a graph showing the distribution of relative electrical current levels for various switch matrix configurations when the electrodes are equally spaced.

Although the use of a plurality of electrodes 4, the plurality of channels, and the associated switch matrix 6 has been demonstrated to provide a large ratio between the maximum and minimum currents and power levels for heating, this is still not sufficient to make a DER liquid heater that meets the objectives of this invention. Provision of uniform spacing between the electrodes 4 (provision of equal channel widths) does not yield uniformly spaced current operating points between switch matrix configurations. FIG. 3 shows the distribution of relative current levels for a DER liquid heater comprising 17 electrodes with equal spacings between the electrodes 4. Although a more than adequate 250:1 range of currents is achieved, there is a large portion of this range for which no switch configuration exists that can yield an intermediate current. In this example, there is a 20 to 1 range of currents for which for which no switch configuration is available. It is impossible to obtain, for example, a current that is 25% of the maximum current. This current level is one that could be quite useful if the liquid flow rate is reduced to 25% or if the liquid conductivity is four times that of the minimum liquid conductivity. Not having this current level means that the average 25% current level has to be achieved by cycling between two current levels that are quite different and which therefore can create power supply fluctuations and accordingly light flickering. Thus, the use of uniformly spaced electrodes does not satisfy the objectives of this invention.

Utilization of non-uniformly spaced electrodes overcomes this difficulty. Selection of the spacing between electrodes can be such that a selection of switch matrix 6 configurations that yield more or less logarithmically uniformly spaced current steps can be achieved. An example of such spacings is discussed later in the description of a preferred embodiment of the invention. The inventors do not know of any method by which the optimum electrode spacings can be analytically calculated and are therefore unable to present such a method. Suitable electrode spacings were "discovered" using a genetic optimization algorithm that had as its objective to minimize the ratio of currents of the largest current step. Other methods for determining an adequate set of electrode spacings also exist. It is the inventors' opinion that adequate electrode spacings should preferably yield a maximum current step size of 10% or less of the maximum current, and a maximum ratio between the two current levels of any step of 1.2, whichever is smaller, between selected switch matrix 6 configurations with optimum electrode spacings. However, any set of electrode spacings and current steps that meet the objectives of the invention are intended to be within its scope.

Figure 4:
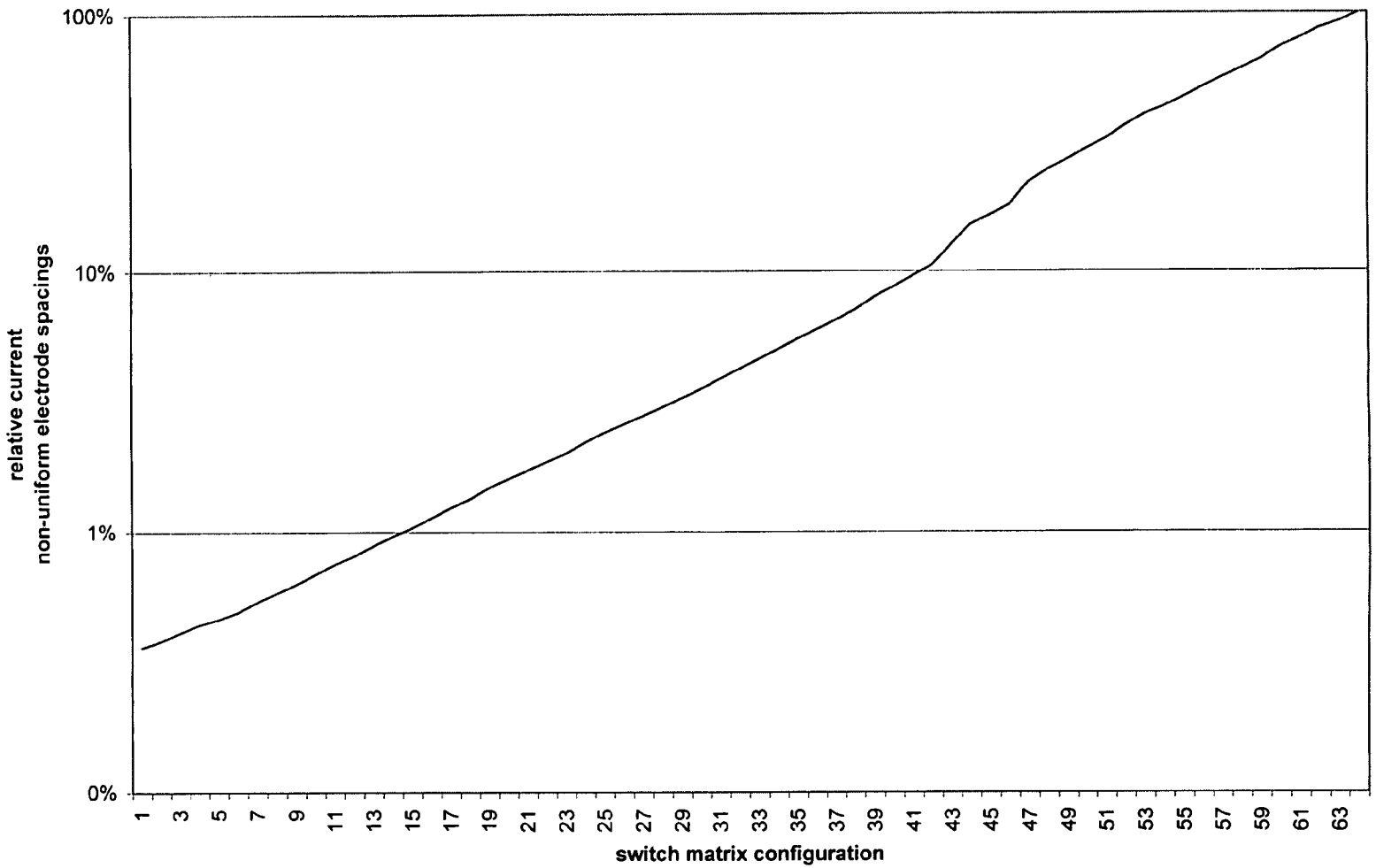
FIG. 4 is a graph that shows relative current levels for a selection of switch matrix configurations with optimally spaced electrodes.

The electrically operable switches preferably comprise semiconductor switches and most preferably comprise triacs. Given their number, it is likely that the cost of the triacs will comprise a significant portion of the parts cost of the liquid heater. The cost of triacs is related to the maximum current that they can handle: higher current capacity triacs cost more. It is therefore desirable to minimize the maximum current requirements for the triacs. The inventors have found that just optimizing the electrode spacing for current step size does not automatically yield a set of electrode spacings that also yields the lowest maximum triac current. However, the inventors have discovered that, using the same genetic optimization algorithm, by adding the additional objective of a maximum triac current, it is possible to generate electrode spacings that simultaneously satisfy the current step size requirements and the maximum triac current requirements. Accordingly, in a most preferred embodiment of the invention, a maximum triac current requirement (so that the lowest cost triac may be used) and current step size requirements are simultaneously satisfied by selection of the electrode spacings. FIG. 4 shows the relative currents achieved from a selection of switch configurations with an optimized set of electrode spacings. With these spacings, the constraint of a maximum triac current has been achieved, the range of currents provided is 308 to 1, and the average current step ratio is approximately 1.10 and the maximum current step ratio is 1.22. The current control range and the step sizes are more than adequate to closely control the temperature of the heated liquid without causing excessive power supply load changes and corresponding light flickering. Additionally, the electrode spacings make possible the operation of the liquid heater at a current that is quite close (5% nominally, 10% worst case) to a current set-point, the current set-point being the maximum current that the liquid heater can draw, without having to rapidly switch between quite different current levels (in order to achieve the set-point current by averaging) and thereby cause the aforementioned light flickering.

An example of the invention will now be discussed. The DER heater of this example was designed to heat water with conductivities of 200 μS/cm to 1500 μS/cm at flow rates of 0.6 gallons per minute to 2.5 gallons per minute and operate from a 220VAC power supply. It was a standard point of use water heater for domestic applications. It comprised 17 electrodes that were 0.9 mm thick by 340 mm long. The channel height, i.e., the height of the electrodes exposed to the liquid (which may be less than the actual physical height of the electrodes in order to accommodate mounting of them) was 8.6 mm. The electrode array comprised sequentially numbered electrodes having the following inter-electrode spacings:

5.49 mm
1.49 mm
5.76 mm
6.22 mm
1.19 mm
5.77 mm
3.82 mm
5.04 mm
5.37 mm
3.15 mm
6.78 mm
6.12 mm
5.49 mm
6.91 mm
3.69 mm
5.11 mm between electrodes numbered 1 and 2, 2 and 3, 3 and 4 respectively through electrodes numbered 16 and 17. These electrode dimensions and spacings resulted in a DER liquid heater having the current control points shown in FIG. 4 where the maximum total current was 55 A and the maximum triac current was 15.5 A when the liquid conductivity was between 200 μS/cm and 1500 μS/cm with a 220VAC power supply.

Figure 5:
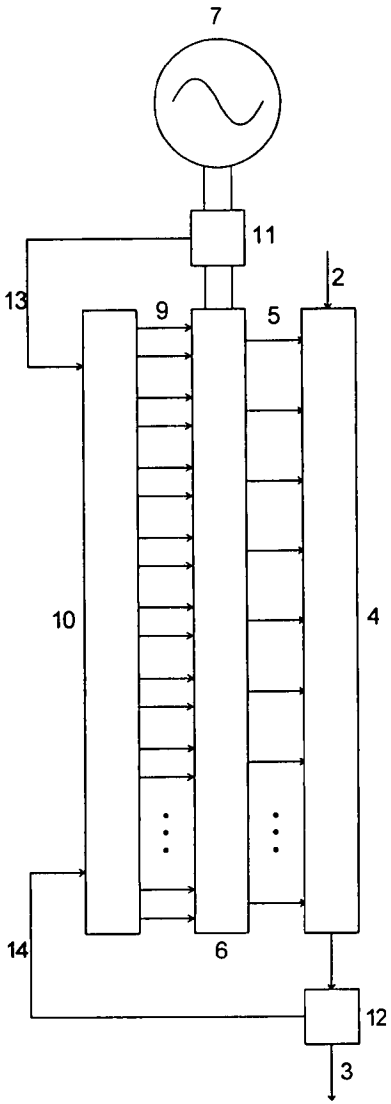
FIG. 5 is a functional block diagram of the DER liquid heater including a current sensor, temperature sensing element, and controller.

A preferred embodiment of the invention has additional aspects and features that make the invention even more useful. Referring now to FIG. 5, a current measurement device 11 is made part of the liquid heater. AC power 7 is communicated to switch matrix 6 via current measurement device 11. A current signal 13, indicative of the current measured by the current measurement device 11, is communicated to the controller 10. The current measurement device 11 and the current signal 13 are used by the controller 10 to respond to the measured current by adjusting switch matrix 6 configuration such that the measured current does not exceed the current set-point. In this way, the maximum current drawn by the DER liquid heater can be controlled, independently of the liquid conductivity or temperature.

Additionally, a temperature-sensing element 12 is disposed at the end of the heating chamber, prior to outlet 3, and generates a temperature signal 14 indicative of the heated liquid temperature. The heated liquid temperature signal 14 is communicated to controller 10 which responds to it by adjusting the configuration of switch matrix 6 such that the water temperature is maintained as close as possible to a temperature set-point, but which, in any case, does not exceed it. The matrix switch configuration is always set such that current set-point takes priority over the temperature set-point. In other words, regardless of the demand for power to heat the liquid to the temperature set-point, the controller prevents drawing more current from the AC power supply 7 than the current set-point.

A power supply (not shown) of well known art for converting the high voltage AC from power supply 7 to a low voltage DC supply suitable for providing power to the controller 10 and other electronic control elements, as required, is also provided. These elements are sufficient to implement a DER liquid heater that meets all of the objectives of the invention.

More details of the example of the invention will now be described for purposes of clarification and to elucidate further improvements of the invention. The switch matrix comprised triacs, one per electrode, connected to the power supply in alternating fashion, i.e., adjacent electrodes were connected to opposite terminals of a two terminal power supply.

The controller comprised a counter to control the power level, in other words, a power level counter, the value of which determined the power level to be applied to the electrodes 4 via the switch matrix 6. The operation of the power level counter was according to the following algorithm that was executed once every cycle of the power supply waveform:

```
if current signal >= current set-point then
decrement the power level counter
else
    if temperature signal = temperature set-point
    then don't change the power level counter
    else
        if temperature signal > temperature set-point
        then decrement the power level counter
        else
        increment the power level counter
```

This algorithm is strictly exemplary and any method of achieving the same operative results is within the scope of the present invention. The counter had a range of values corresponding to power levels between zero power and a maximum power level. The algorithm also incorporated a mechanism to ensure that the operating range of the counter was not exceeded. The values of the counter are converted to switch matrix control signals 9 by any suitable means. For the present example, the following look-up table was used:

| power level | SW17 | SW16 | SW15 | SW14 | SW13 | SW12 | SW11 | SW10 | SW9 | SW8 | SW7 | SW6 | SW5 | SW4 | SW3 | SW2 | SW1 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 | 0 | 0 | 0 | 1 | 0 |
| 2 | 0 | 1 | 0 | 0 | 0 | 0 | 0 | 0 | 0 | 0 | 0 | 0 | 0 | 0 | 1 | 0 | 0 |
| 3 | 0 | 0 | 0 | 1 | 0 | 0 | 0 | 0 | 0 | 0 | 0 | 0 | 0 | 0 | 0 | 0 | 1 |
| 4 | 1 | 0 | 0 | 0 | 0 | 0 | 0 | 0 | 0 | 0 | 0 | 1 | 0 | 0 | 0 | 0 | 0 |
| 5 | 0 | 1 | 0 | 0 | 0 | 0 | 0 | 0 | 0 | 0 | 0 | 0 | 1 | 0 | 0 | 0 | 0 |

-continued

| power level | SW17 | SW16 | SW15 | SW14 | SW13 | SW12 | SW11 | SW10 | SW9 | SW8 | SW7 | SW6 | SW5 | SW4 | SW3 | SW2 | SW1 |
|---|---|---|---|---|---|---|---|---|---|---|---|---|---|---|---|---|---|
| 6 | 0 | 0 | 0 | 0 | 1 | 0 | 0 | 0 | 0 | 0 | 0 | 0 | 0 | 0 | 0 | 1 | 0 |
| 7 | 1 | 0 | 0 | 0 | 0 | 0 | 0 | 0 | 0 | 1 | 0 | 0 | 0 | 0 | 0 | 0 | 0 |
| 8 | 0 | 0 | 0 | 0 | 1 | 0 | 0 | 0 | 0 | 0 | 0 | 0 | 0 | 1 | 0 | 0 | 0 |
| 9 | 0 | 0 | 0 | 0 | 0 | 0 | 0 | 1 | 0 | 0 | 0 | 0 | 0 | 0 | 0 | 0 | 1 |
| 10 | 1 | 0 | 0 | 0 | 0 | 0 | 0 | 1 | 0 | 0 | 0 | 0 | 0 | 0 | 0 | 0 | 0 |
| 11 | 1 | 0 | 0 | 0 | 0 | 0 | 0 | 0 | 0 | 0 | 0 | 0 | 0 | 1 | 0 | 1 | 0 |
| 12 | 0 | 0 | 0 | 0 | 0 | 1 | 0 | 0 | 0 | 0 | 0 | 0 | 1 | 0 | 0 | 0 | 0 |
| 13 | 0 | 1 | 0 | 0 | 0 | 0 | 1 | 0 | 0 | 0 | 0 | 0 | 0 | 0 | 0 | 0 | 0 |
| 14 | 0 | 0 | 0 | 0 | 1 | 0 | 0 | 0 | 0 | 1 | 0 | 0 | 0 | 0 | 0 | 0 | 0 |
| 15 | 0 | 0 | 0 | 1 | 0 | 0 | 0 | 1 | 0 | 0 | 0 | 0 | 0 | 0 | 0 | 0 | 1 |
| 16 | 1 | 0 | 0 | 0 | 0 | 0 | 0 | 1 | 0 | 0 | 0 | 1 | 0 | 0 | 0 | 0 | 0 |
| 17 | 0 | 0 | 0 | 1 | 0 | 0 | 0 | 1 | 0 | 0 | 0 | 0 | 0 | 0 | 1 | 0 | 0 |
| 18 | 0 | 0 | 1 | 0 | 0 | 0 | 0 | 1 | 0 | 0 | 0 | 0 | 0 | 1 | 0 | 0 | 0 |
| 19 | 0 | 0 | 0 | 0 | 1 | 0 | 0 | 0 | 0 | 1 | 0 | 0 | 0 | 0 | 0 | 1 | 0 |
| 20 | 0 | 1 | 0 | 0 | 0 | 0 | 0 | 0 | 0 | 0 | 0 | 1 | 0 | 0 | 0 | 0 | 1 |
| 21 | 1 | 0 | 0 | 0 | 0 | 1 | 0 | 0 | 0 | 0 | 0 | 0 | 1 | 0 | 0 | 0 | 0 |
| 22 | 1 | 0 | 0 | 0 | 0 | 0 | 0 | 1 | 0 | 0 | 0 | 0 | 1 | 0 | 0 | 0 | 0 |
| 23 | 0 | 1 | 0 | 0 | 0 | 0 | 1 | 0 | 1 | 0 | 0 | 0 | 0 | 1 | 0 | 0 | 0 |
| 24 | 0 | 0 | 0 | 1 | 0 | 0 | 0 | 0 | 1 | 0 | 1 | 0 | 0 | 0 | 0 | 1 | 0 |
| 25 | 0 | 1 | 0 | 0 | 1 | 0 | 1 | 0 | 0 | 0 | 0 | 0 | 0 | 1 | 0 | 0 | 0 |
| 26 | 0 | 0 | 0 | 1 | 0 | 0 | 1 | 0 | 0 | 0 | 1 | 0 | 0 | 0 | 0 | 1 | 0 |
| 27 | 1 | 0 | 0 | 0 | 0 | 1 | 0 | 0 | 0 | 1 | 0 | 0 | 0 | 0 | 0 | 0 | 1 |
| 28 | 0 | 0 | 1 | 0 | 0 | 0 | 0 | 1 | 0 | 1 | 0 | 0 | 0 | 0 | 0 | 0 | 1 |
| 29 | 0 | 0 | 0 | 1 | 0 | 0 | 1 | 0 | 0 | 0 | 0 | 0 | 1 | 0 | 0 | 1 | 0 |
| 30 | 0 | 1 | 0 | 0 | 1 | 0 | 0 | 0 | 0 | 0 | 0 | 1 | 0 | 0 | 0 | 0 | 1 |
| 31 | 0 | 0 | 0 | 1 | 0 | 1 | 0 | 0 | 1 | 0 | 1 | 0 | 0 | 0 | 0 | 1 | 0 |
| 32 | 0 | 1 | 0 | 0 | 0 | 0 | 0 | 1 | 0 | 0 | 1 | 0 | 1 | 0 | 0 | 1 | 0 |
| 33 | 0 | 1 | 0 | 0 | 1 | 0 | 1 | 0 | 0 | 0 | 0 | 1 | 0 | 0 | 1 | 0 | 0 |
| 34 | 1 | 0 | 0 | 1 | 0 | 0 | 1 | 0 | 1 | 0 | 0 | 0 | 0 | 1 | 0 | 1 | 0 |
| 35 | 0 | 0 | 1 | 0 | 0 | 0 | 0 | 1 | 0 | 1 | 0 | 0 | 0 | 1 | 0 | 0 | 1 |
| 36 | 0 | 1 | 0 | 0 | 1 | 0 | 0 | 0 | 0 | 1 | 0 | 0 | 0 | 1 | 0 | 0 | 1 |
| 37 | 1 | 0 | 0 | 1 | 0 | 0 | 0 | 0 | 1 | 0 | 1 | 0 | 0 | 1 | 0 | 0 | 1 |
| 38 | 1 | 0 | 0 | 1 | 0 | 1 | 0 | 0 | 1 | 0 | 1 | 0 | 0 | 1 | 0 | 0 | 0 |
| 39 | 0 | 1 | 0 | 0 | 1 | 0 | 0 | 0 | 1 | 0 | 0 | 1 | 0 | 1 | 0 | 0 | 1 |
| 40 | 1 | 0 | 0 | 1 | 0 | 1 | 0 | 1 | 0 | 0 | 1 | 0 | 1 | 0 | 0 | 1 | 0 |
| 41 | 0 | 0 | 1 | 1 | 0 | 1 | 1 | 0 | 1 | 0 | 0 | 0 | 0 | 1 | 0 | 1 | 0 |
| 42 | 0 | 0 | 1 | 1 | 0 | 1 | 1 | 0 | 1 | 0 | 0 | 1 | 0 | 0 | 0 | 0 | 1 |
| 43 | 0 | 0 | 1 | 1 | 0 | 1 | 1 | 0 | 0 | 0 | 1 | 0 | 0 | 1 | 0 | 0 | 1 |
| 44 | 0 | 0 | 1 | 1 | 0 | 1 | 1 | 0 | 1 | 0 | 0 | 1 | 0 | 1 | 0 | 0 | 1 |
| 45 | 0 | 0 | 1 | 1 | 0 | 1 | 1 | 0 | 0 | 0 | 1 | 1 | 0 | 1 | 1 | 0 | 0 |
| 46 | 0 | 0 | 0 | 0 | 1 | 1 | 0 | 1 | 1 | 0 | 0 | 0 | 1 | 1 | 0 | 1 | 1 |
| 47 | 1 | 1 | 0 | 1 | 1 | 0 | 0 | 0 | 1 | 1 | 0 | 0 | 0 | 0 | 0 | 1 | 1 |
| 48 | 1 | 1 | 0 | 1 | 1 | 0 | 0 | 1 | 1 | 0 | 1 | 1 | 0 | 1 | 0 | 0 | 1 |
| 49 | 0 | 1 | 1 | 0 | 1 | 1 | 0 | 0 | 0 | 1 | 1 | 0 | 1 | 1 | 0 | 1 | 1 |
| 50 | 0 | 1 | 1 | 0 | 1 | 1 | 0 | 0 | 1 | 1 | 0 | 0 | 1 | 1 | 0 | 1 | 1 |
| 51 | 0 | 0 | 1 | 1 | 1 | 0 | 1 | 1 | 0 | 1 | 1 | 0 | 1 | 1 | 0 | 1 | 1 |
| 52 | 1 | 1 | 0 | 1 | 1 | 1 | 1 | 0 | 0 | 1 | 1 | 0 | 1 | 1 | 0 | 1 | 1 |
| 53 | 0 | 1 | 1 | 1 | 1 | 1 | 1 | 0 | 1 | 1 | 0 | 0 | 1 | 1 | 1 | 0 | 0 |
| 54 | 0 | 1 | 1 | 1 | 1 | 1 | 1 | 0 | 1 | 1 | 1 | 0 | 1 | 1 | 1 | 0 | 0 |
| 55 | 0 | 1 | 1 | 1 | 1 | 1 | 1 | 1 | 0 | 1 | 1 | 0 | 1 | 1 | 1 | 0 | 0 |
| 56 | 1 | 1 | 1 | 1 | 1 | 1 | 1 | 1 | 0 | 1 | 1 | 0 | 0 | 1 | 0 | 1 | 1 |
| 57 | 0 | 1 | 1 | 1 | 1 | 1 | 1 | 1 | 1 | 1 | 1 | 1 | 0 | 1 | 0 | 0 | 1 |
| 58 | 1 | 1 | 1 | 1 | 1 | 1 | 1 | 1 | 1 | 1 | 1 | 1 | 0 | 1 | 0 | 0 | 1 |
| 59 | 1 | 1 | 1 | 1 | 1 | 1 | 1 | 1 | 1 | 1 | 0 | 0 | 1 | 0 | 1 | 1 | 0 |
| 60 | 0 | 1 | 1 | 1 | 1 | 1 | 1 | 1 | 1 | 1 | 1 | 1 | 0 | 0 | 1 | 1 | 0 |
| 61 | 0 | 1 | 1 | 1 | 1 | 1 | 1 | 1 | 1 | 1 | 0 | 1 | 1 | 0 | 1 | 1 | 0 |
| 62 | 1 | 1 | 1 | 1 | 1 | 1 | 1 | 1 | 1 | 0 | 0 | 1 | 1 | 0 | 1 | 1 | 1 |
| 63 | 1 | 1 | 1 | 1 | 1 | 1 | 1 | 1 | 1 | 0 | 0 | 1 | 1 | 1 | 1 | 1 | 1 |
| 64 | 1 | 1 | 1 | 1 | 0 | 1 | 1 | 1 | 1 | 1 | 1 | 1 | 1 | 1 | 1 | 1 | 1 |
| 65 | 1 | 1 | 1 | 1 | 1 | 1 | 1 | 1 | 1 | 1 | 1 | 1 | 1 | 1 | 1 | 1 | 1 |

where '0' means that the switch was operatively open and '1' means that the switch was operatively closed and SW1 through SW17 refer to the switches connected to electrodes 1 through 17 respectively. At power level 0, all of the switches 6 were open and no power was applied for heating the liquid. At power level 65, all of the switches 6 were closed and maximum power was applied for heating liquid. The intermediate power levels correspond to the relative current levels shown in FIG. 4. For many of the power levels, the selection of switch matrix 6 configuration is not unique. There sometimes exist other switch matrix configurations that yield identical or similar currents. In fact, the choice of relative current for any power level is somewhat arbitrary in that, for many power levels, there exist lower or higher power levels that can be achieved with other switch combinations that are so close to the selected power level so as to be essentially equivalent. In general, the choices that were made in the exemplary table were driven by the desire to involve as many electrodes as possible in heating the liquid at any given power level or to involve the greatest width of the heating zone as defined by the distance between the two electrodes to which power is applied. However, other trade-offs may also apply to the choice of power levels and switch configurations that could change the selection of entries in the look up table. Furthermore, it is also possible that a power level in the look-up table to correspond to more than one entry, such as in a linked list. In this case, it is possible for the controller to cycle through the various entries for a given power level so as to possibly more evenly distribute the heating within the heating chamber. Thus, the above look up table is meant to be purely exemplary.

In a broader view of the invention, a power level value is increased or decreased according to the measured current and measured temperature such that the measured current is maintained at a level below or equal to the current set-point, and that, when possible, the measured liquid temperature is maintained at the temperature set-point and the power level value is converted into switch matrix 6 configurations so as to deliver the desired heating power to the liquid. The power level value may be any electronically representable value, for example, a digital number, an analog voltage or analog current, and the translation of the power level value to switch matrix configuration is by any suitable mechanism.

The algorithm was executed once per every cycle of the AC power supply 7 and thus caused the maximum rate of change of the load to the power supply to be nominally 10% per cycle in this example of the invention. It took 65 cycles to effect a change of current from zero current to maximum current (over 1 second for a 50 Hz or 60 Hz power supply). This slow rate of change essentially eliminated power supply voltage fluctuations that can lead to flickering of lights, yet, because of the small current step ratios which enable the system to find an optimum power level, it was more than fast enough to regulate the temperature of the liquid. In addition, the triacs were operatively closed at the zero crossing of the power supply waveform, as is known and customary, thereby creating virtually no electromagnetic or radio frequency interference, and eliminating the need for additional filtering components. Additionally, an optimal resistive load was always presented to the power supply.

In a preferred embodiment of the invention, the temperature-sensing element 12 comprises a perforated thermally conductive temperature sensing plate, a semiconductor junction based temperature sensor, and a temperature signal conditioner. The plate is placed as close as practicable to the end of the heating chamber and perpendicular to the flow of the liquid such that the liquid leaving the heating chamber must pass through the perforations in the temperature sensing plate. Assuming that the plate is electrically conductive, the limit to how close the plate can be placed to the ends of the electrodes is based upon non-interference of the plate with normal heating operation of the electrodes. A suitable non-electrically conductive plate may be used. In this case, it may be desirable to align the perforations of the plate with channels defined by the electrodes 4 and place it immediately at the exit end of the channels defined by them. There are two objectives that the design of the temperature sensing plate and its placement achieves. The first is that the temperature of the liquid in the heating chamber is accurately sensed, even when there is no liquid flow. The second is that, even in the presence of gas bubbles and independent of heater orientation, the temperature of the liquid that flows from the outlet 3 is accurately sensed.

Although thermistors or thermocouple junctions may suitably be used as the temperature sensor of the present invention, a semiconductor junction, such as a diode or the base-emitter junction of a transistor is preferred for reasons of low cost, easy availability and a high degree of repeatability that eliminates the need for calibration. The semiconductor junction may be a separate component or incorporated as part of a larger integrated circuit that may also contain some or all of the temperature signal conditioner. The temperature signal conditioner converts the voltages from the temperature sensor to a temperature signal suitable for the controller. Additionally, it at least partially compensates for the thermal lag or delay seen between the temperature of the heated liquid and that sensed by the thermal sensor because of the combination of thermal resistance of the thermal plate and packaging of the thermal sensor and the thermal mass of them. This conditioning is well known art and typically involves creating a signal representative of the rate of change of the temperature as measured by the temperature sensor and summing this with the signal representing the temperature as measured by the temperature. This compensation helps to stabilize the operation of the temperature control loop. The temperature signal conditioner may also partially or wholly exist within the controller if that is more suitable. In any case, it is most desirable that the temperature signal communicated to the portion of the controller that implements the method for selecting the power level be as accurate an indication of actual liquid temperature as possible.

In another feature of the example, the semiconductor switches 8 were connected electrically and thermally to the electrodes 4 so as to simultaneously provide connections 5 for both electrical current from the semiconductor switches 8 to the electrodes 4 and for the heat generated within the semiconductor switches 8 to the incoming liquid via the electrodes 4. Each connection 5 was placed at or near the end of the electrode closest to the inlet 2 where the liquid is relatively cool. This required electrodes 4 that are both highly electrically conductive and thermally conductive. Preferably, the electrical and thermal conductivities of the electrodes are equal to or greater than those of aluminum. The semiconductor switches 8 were packaged in a package that has a thermally and electrically conductive surface that can be applied directly to the electrode or a feature of the electrode to make the connection 5, in this example, the JEDEC TO-220 package. This package provided a relatively large flat surface that has been designed to communicate heat generated by the semiconductor device packaged inside of it to a heat sink to which it is generally attached. In many instances, and a requirement of this feature, the flat heat conducting surface of the TO-220 package (or any other suitable package) also is connected to a main terminal of the semiconductor switch 8, a main terminal being a terminal not dedicated to controlling the operation of the switch 8, but rather one through which the switchable current passes. The connection is made in any suitable manner such that the electrical and thermal conductances across the connection 5 are adequate for good performance. A connection that is under mechanical compression is most preferred. In the present example, the mechanical compression was effected with a spring clamp and the connections made between the TO-220 packages and tabs of the electrodes that came through the housing of the heating chamber for purpose of making the connections 5 to the switch matrix 6.

For reasons of maximizing the operating life of the heater, the electrodes are mechanically robust and resistant to corrosion. Preferably the electrodes comprise carbon. Most preferably, the electrodes comprise a combination of graphite and polymer and/or elastomer. The polymer and/or elastomer comprises only a small percentage of the total volume of the electrode and is used primarily for purposes of binding the graphite. The graphite is most preferably oriented graphite with an orientation such that it has highest electrical and thermal conductivity within the plane of the electrode. This electrode composition satisfies the electrical and thermal conductivity needs and also provides and electrode that is largely immune to electrochemical corrosion. Such electrodes may be fabricated by any suitable method. Metallic electrodes, though not preferred because of the poor corrosion resistance, are within the scope of the invention. Current art conductive plastic electrodes are not suitable because they do not achieve the required electrical and thermal conductivities. However, this may change in the future and, as such, electrodes of such composition are within the scope of the invention if they provide adequate electrical and thermal conductivities and resistance to degradation in the presence of the liquid. The electrodes may comprise additional elements or materials so as to provide all of the properties required for good performance and lifetime.

It will be appreciated by those skilled in the art that for a given set of electrode spacings and a desired electrode channel defining area, which sets the electrical conductances of the channels, there exists an infinite range of electrode dimensions that would simply heat the liquid and meet the already cited requirements. An additional objective, however, is to minimize the formation of deposits on the electrodes, thereby extending the operating life of the heater. This is accomplished by setting the average velocity of the liquid flow in the channels such that it is at the onset of turbulence. The method of calculation of the velocity of the onset of turbulence for a channel of defined dimensions and cross-section is well known and will not be discussed here. The liquid flow velocity is a function of the channel height with smaller heights giving higher liquid flow velocities for a given volumetric flow rate. Thus, satisfying the constraints of the electrode height, for reasons of obtaining the requisite liquid flow velocity for a desired volumetric flow rate, and the electrode channel defining area, in order to achieve the desired channel electrical conductance, sets the optimum electrode dimensions. These electrode dimensions are unique in that there are no other electrode dimensions that simultaneously satisfy all of the requirements of a preferred embodiment of the invention. The electrode dimensions of the example satisfy these requirements. It is noted, however, that the velocity for the onset of turbulence is not a singular number, but a range, since turbulence itself is not strictly a binary quantity or quality. Thus, in a preferred embodiment, the optimum electrode dimensions fall within a narrow range determined both by the range of velocities associated with the onset of turbulence and the other parameters associated with the overall design of the liquid heater.

It is known in DER heaters that, absent electrodes to collect it, electrical leakage current can be created. Generally, this is of a small magnitude, but for reasons of safety, it should be essentially eliminated. A preferred embodiment of the invention also includes two leakage current collecting electrodes, one between the liquid inlet 2 and the heating chamber, and the other between the heating chamber and liquid outlet 3. They are electrically connected to an electrically neutral voltage. These electrodes may be of similar design as the electrodes used to heat the liquid or comprise any electrical conductor that is suitably corrosion resistant. They are designed and located so as to maximize the surface area of contact between the liquid and the electrodes and preferably centered in any channel defined by the heater vessel walls associated with the inlet 2 and outlet 3. The length of the leakage current electrodes is at least twice and preferably 10 or more times the largest distance between the electrode and the vessel wall along a line drawn between the electrode and vessel wall perpendicular to the leakage current electrode. The inventors have found that provision of such leakage current electrodes can reduce the current leakage current to below 1 μA, well below a value that is considered to be hazardous to human beings. Other leakage current electrode configurations that achieve this are also suitable.

No flow measurement device is mentioned as part of this invention. In preferred embodiments of the invention, it is specifically absent. The combination of the preferred temperature sensing element 12, the optimally spaced electrodes 4 which provide a wide current control range and fine adjustability of power, the switch matrix 6 and the controller 10 are sufficient to control the liquid temperature for all flow velocities, including zero, and for all orientations of the DER liquid heater. Furthermore, the DER liquid heater of this invention is able to provide virtually instant heated liquid availability because it maintains the small reservoir of liquid within its heating chamber at or close to the temperature set-point and is able to respond very quickly to liquid flow rate changes due to the very small latent heat associated with the electrodes 4 and a rapid response by the temperature sensing element 12. Thus, wastage of liquid due to the delivery of unheated liquid is largely eliminated.

It will be recognized and understood that various modifications and alterations may be made to the embodiments of the invention herein described without departing from the scope and spirit of the invention. Therefore, this invention is not to be limited by the embodiments shown in the drawings and described in the description, which are given by way of example and not of limitation, but only in accordance with the appended claims.

We claim:

1. A liquid heater comprising a chamber having an inlet and an outlet, and at least three electrodes within said chamber defining a plurality of adjacent channels for liquid flow from said inlet to said outlet whereby the liquid flow is divided between the channels and wherein the liquid is heated by electrical current flow through the liquid between two or more of said at least three electrodes;

an electrical power supply connection; and at least one switch for each of said electrodes, the at least one switch being arranged to removably connect each of said electrodes to the power supply connection independent of the remaining ones of said electrodes, the electrodes being non-uniformly spaced apart from one another with different distances between different pairs of mutually-adjacent ones of the electrodes, so that connection of different sets of the electrodes to the electrical power supply connection provides different levels of current passing through the liquid, the levels of current including levels defining a stepwise progression between zero current when none of the electrodes are connected and a maximum current when all of the electrodes are connected, the progression having substantially uniform ratios between the currents of adjacent steps with non-zero current levels.

2. A liquid heater as in claim 1 further comprising a controller controlling the operation of the at least one switch for each of the electrodes and thereby controlling connection of said electrodes to the electrical power supply connection.

3. A liquid heater as in claim 2 further comprising a temperature sensor sensing the temperature of the liquid, wherein the controller controls the operation of said at least one switch based upon information received from the temperature sensor.

4. A liquid heater as in claim 2 further comprising a temperature sensor sensing the temperature of the liquid after it passes through the channels, wherein the controller controls the operation of said at least one switch based upon information received from the temperature sensor.

5. A liquid heater as in claim 1 wherein said at least one switch for each of said electrodes are physically attached to said electrodes to facilitate the removal of generated heat from said switch, into said electrode, and into the liquid to be heated.

6. A liquid heater as in claim 2 further comprising an electric current sensor sensing the amount of electric current being utilized by the liquid heater, wherein said controller controls the operation of said at least one switch for each of said electrodes, based upon information received from said electric current sensor.

7. A liquid heater as in claim 2 further comprising a temperature sensor sensing the temperature of the liquid, and an electric current sensor sensing the amount of electric current being utilized by the liquid heater, wherein said controller controls the operation of said at least one switch for each of said electrodes, based upon information received from said temperature sensor and from said electric current sensor.

8. A liquid heater as in claim 1 further comprising a pair of electric current leakage electrodes, one located in said chamber adjacent said inlet, and the other located in said chamber adjacent said outlet, both of said electric current leakage electrodes connected to each other and to an electrically neutral voltage source.

9. A liquid heater as in claim 1 wherein said at least three electrodes are manufactured from a combination of oriented graphite and polymer binder.

10. A liquid heater as in claim 1 wherein there is one switch for each of said electrodes, and the power supply connection has two opposite terminals, and wherein said switches removably connect mutually-adjacent ones of said electrodes to opposite terminals of the power supply connection.

11. A liquid heater as in claim 1 wherein said power supply connection is a three-phase connection having three terminals and said at least one switch for each of said electrodes removably connects each of said electrodes to one of the terminals of the three phase connection.

12. A liquid heater as in claim 1 wherein said power supply connection is a three-phase connection having three terminals and the at least one switch for each of the electrodes includes three switches for each of said electrodes, said switches removably connecting each of said electrodes to each terminal of the three phase connection.

13. A liquid heater as in claim 1 wherein the power supply connection has two opposite terminals and said at least one switch for each of said electrodes connects each of said electrodes to one or the other terminal of the power supply connection.

14. A liquid heater as in claim 1 wherein said controller can connect and disconnect any combination of said electrodes to the power supply connection by operating said switches.

15. A liquid heater as in claim 2, wherein said controller is operative to control the switches so as to cycle through different combinations of said electrodes that yield similar current levels, whereby the current applied to the liquid is more evenly distributed throughout the liquid and said electrodes are more evenly utilized.

16. A liquid heater as in claim 1, wherein a greatest difference between the levels of current in any two adjacent steps of the progression is no greater than 10% of the maximum current.

17. A liquid heater as in claim 1, wherein a greatest ratio between the currents in any two adjacent steps of the progression having non-zero currents is no more than 1.22:1.

18. A liquid heater as in claim 17, wherein the greatest ratio is no more than 1.1:1.

19. A liquid heater as in claim 1, wherein a greatest difference between the levels of current in any two adjacent steps of the progression is no greater than 5% of the maximum current.

20. A liquid heater as in claim 1 wherein the number of said electrodes, the number of said switches, and the spacing of said electrodes is sufficient to provide at least 60 different current levels in said stepwise progression.

21. A liquid heater as in claim 4, wherein said controller controls the application of electrical power to said electrodes based upon the temperature sensed by said temperature sensor and the rate of change of the temperature sensed by said temperature sensor.

22. A liquid heater as claimed in claim 4 wherein said controller periodically determines if the combination of said electrodes connected to the power supply connection needs to be changed to raise or lower the current level applied to the liquid to be heated, based upon information received from said temperature sensor and a desired liquid temperature at said chamber outlet.

23. A liquid heater as in claim 22 wherein said controller limits the rate of change of electrical current applied to said electrodes, thereby limiting surges in power levels that could impact other users of the power source used by the liquid heater.

24. A liquid heater as in claim 23 wherein said controller limits the rate of change of electrical current applied to said electrodes, by adjusting the current applied to said electrodes only to the next highest or lowest available current level provided by a combination of said electrodes, each time said controller periodically determines if there needs to be a change in the current level applied to the liquid to be heated.

25. A liquid heater as in claim 24 wherein said controller limits the rate of change of electrical current applied to said electrodes by only determining if the combination of said electrodes connected to a power supply needs to be changed once every cycle of an alternating current supplied to the power supply connection.

26. A liquid heater as in claim 1 wherein said electrodes are planar, thin, and rectangular.

27. A liquid heater as in claim 1 wherein said chamber and said electrodes are sized and spaced such that the design rate of liquid flow through the channels between said electrodes is in the range of transition between laminar flow and turbulent flow.

28. A liquid heater as in claim 1 wherein a ratio between the maximum current and a minimum non-zero current in said progression is at least 250:1.

* * * * *